US007775851B2

(12) United States Patent
Sgro

(10) Patent No.: US 7,775,851 B2
(45) Date of Patent: Aug. 17, 2010

(54) FABRIC BREAST SUPPORT WORN IN SHOWER TO SUPPORT AND PROTECT BREASTS AND PROTECT BREASTS AND RELIEVE BREAST AND NIPPLE PAIN ASSOCIATED WITH PREGNANCY, CHILDBIRTH AND NURSING

(76) Inventor: Andria M. Sgro, 2683 Via De La Valle, Suite G341, Del Mar, CA (US) 92014

( * ) Notice: Subject to any disclaimer, the term of this patent is extended or adjusted under 35 U.S.C. 154(b) by 0 days.

(21) Appl. No.: 12/208,618

(22) Filed: Sep. 11, 2008

(65) Prior Publication Data

US 2009/0004950 A1 Jan. 1, 2009

Related U.S. Application Data

(63) Continuation-in-part of application No. 11/611,867, filed on Dec. 17, 2006, now abandoned.

(51) Int. Cl.
*A41C 3/00* (2006.01)

(52) U.S. Cl. ..... 450/79; 450/1

(58) Field of Classification Search ..... 450/36, 450/37, 58, 54, 7–10, 15–18, 65–67, 79, 450/82; 2/104–106, 113–115, 69; 604/73–76, 604/118, 119

See application file for complete search history.

(56) References Cited

U.S. PATENT DOCUMENTS

| | | | | | |
|---|---|---|---|---|---|
| 2,723,396 | A | * | 11/1955 | Stack | 450/58 |
| 3,968,803 | A | * | 7/1976 | Hyman | 602/79 |
| 5,527,270 | A | * | 6/1996 | Chase et al. | 602/41 |
| 6,015,331 | A | * | 1/2000 | Ioakim | 450/37 |

* cited by examiner

*Primary Examiner*—Gloria Hale
(74) *Attorney, Agent, or Firm*—Thomas D. Foster; M. Reza Savari

(57) ABSTRACT

A soft, protective breast support worn by pregnant, postpartum and nursing mothers when showering to support engorged breasts, function as a warm compress to soothe breasts and ease engorgement, and to shield the breasts, nipples and areolas from direct contact with harsh shower sprays, drying soap and other chemical residues found in toiletries that can damage sensitive nipple and areola skin, while leaving the wearer's hands free. The breast support is a two-sided, rectangular fabric panel made of soft, lightweight, elastic and absorbent material. The wearer snuggly wraps the fabric panel lengthwise around her bustline and back, so that the width of the panel covers the breasts, and attaches the opposing ends of the panel along the front mid-line of her chest using a hook and loop closure mechanism.

6 Claims, 4 Drawing Sheets

FABRIC BREAST SUPPORT WORN IN SHOWER TO SUPPORT AND PROTECT BREASTS AND PROTECT BREASTS AND RELIEVE BREAST AND NIPPLE PAIN ASSOCIATED WITH PREGNANCY, CHILDBIRTH AND NURSING

RELATED DOCUMENTS

The present application is a continuation-in-part of U.S. application Ser. No. 11/611,867, which is now abandoned, filed Dec. 17, 2006, entitled "Fabric Breast Support Worn in Shower to Support and Protect Breasts and Relieve Breast and Nipple Pain Associated With Pregnancy, Childbirth and Nursing", which is incorporated herein in its entirety.

FIELD OF INVENTION

This invention relates to a fabric breast support worn in the shower to support and protect the breasts and nipples of pregnant, postpartum and nursing mothers and to relieve breast and nipple pain associated with pregnancy, childbirth and nursing while leaving the wearer's hands free.

BACKGROUND

Hormonal changes, let-down of breast milk, nursing and other conditions associated with pregnancy, childbirth and nursing cause physical pain, soreness and irritation to a mother's body and, in particular, her breasts and nipples. Pregnant, postpartum and nursing mothers commonly experience the sensations of breast heaviness and tenderness caused by swelling and engorgement; nipple trauma including cracked, blistered and bleeding nipples caused by early stage nursing and improper latch of infant's mouth to mother's areola and nipple; plugged milk ducts or localized blockages of milk in the breast caused by ineffective drainage of the breast, blocked nipple pores, or wearing of restrictive brassieres and clothing; and breast infections characterized by soreness, redness and hard spots in the area of the breast that is affected.

While healthcare providers and lactation consultants recommend warm showers to help soothe the breast area and ease engorgement, the act of showering itself presents problems to pregnant, postpartum and nursing mothers. First, the direct force of shower sprays on tender breasts and irritated nipples is quite painful. Second, drying ingredients and chemical additives found in many toiletries further irritate injured nipples and areolas. The routine task of showering becomes difficult and rushed as the pregnant or new mother races to shampoo, condition, soap and shave with one hand and shield her breasts and nipples from stinging shower sprays, soap and other chemical residues with the other hand. As a result, the comforting properties of warm shower water flowing over the breast area are diminished.

To address these issues, healthcare providers and lactation consultants routinely advise their patients to place a washcloth or towel over the breast and nipple area while showering to 1) create a physical barrier between the breast area and stinging shower sprays, soap and other chemical residues found in many toiletries and 2) achieve a warm compress effect to alleviate breast discomfort caused by swelling, engorgement, localized blockages of milk ducts, nipple trauma and breast infection. However, this method is ineffective and inefficient as evidenced by the following problems:

(a) Washcloths, towels and towel wraps are not the proper size to suitably cover the breast and nipple area. Washcloths are too small, requiring the mother to hold multiple cloths over the breast area. Towels and towel wraps are too large and, as a result, cover more body area than preferred and become excessively heavy and cumbersome when wet. This invention is suitably sized in that its length is sufficient to wrap around the bustline and back of a pregnant, postpartum or nursing mother, which is generally within but not limited to the range of thirty five (35) to forty three (43) inches, and its width is sufficient to adequately cover the breasts and nipples, which is generally within but not limited to the range of nine (9) to eleven (11) inches, without covering more body area than desired.

(b) Wet towels and towel wraps become excessively heavy and cumbersome when wet, placing surplus weight on the mother's breasts that are already heavy and engorged as a result of pregnancy, childbirth and nursing. This increased pressure contributes to breast pain and discomfort and increases strain on delicate, stretched breast tissue.

(c) Washcloths and towels must be manually held in place with at least one hand, leaving only one hand free to shower. Routine tasks of opening toiletry bottles, shampooing, conditioning and shaving become difficult when only one hand is available to perform the activity. Towel wraps, including those with elasticized bands around the top and those which utilize hook and loop fasteners, become excessively heavy when wet; the elasticized bands around the top of the towel wrap that generally hold the towel wrap in place are not sufficient to do so when the towel wrap is saturated with water.

(d) Washcloths, towels and towel wraps do not provide any level of support to the breasts when held over the breast and nipple area. Rather, they place surplus weight on the mother's breasts which contributes to breast pain and discomfort and increases strain on delicate, stretched breast tissue.

(e) Washcloths, towels and towel wraps, when draped over the breast and nipple area, do not effectively function as a warm compress. A compress is defined in the American Heritage Dictionary as "a soft pad of gauze or other material applied with pressure to a part of the body to control hemorrhage or to supply heat, cold, moisture, or medication to alleviate pain or reduce infection." When used in the shower, washcloths, towels and towel wraps cannot be applied with sufficient firmness or snugness to effectively compress or apply pressure to the breast area without significant manual intervention on the part of the user to hold them in place and to apply the pressure. These mechanisms have no means of providing appropriate pressure without the direct assistance of the wearer.

(f) Wet towels and towel wraps require increased effort to wring out, dry and launder due to their size and weight, especially when wet.

Currently, the only method to support, protect and relieve tender breasts and nipples associated with pregnancy, childbirth and nursing while showering is for the mother to manually hold or support washcloths, towels or towel wraps over her breast and nipple area. There is no other device or method otherwise available for this use.

This invention is a fabric breast support worn in the shower to support and protect the breasts and nipples of pregnant, postpartum and nursing mothers and to relieve breast and nipple pain associated with pregnancy, childbirth and nursing while leaving the wearer's hands free. This device is not a tube top. A tube top is defined by Dictionary.com Unabridged (v 1.1) as "a woman's strapless top, usually of elasticized fabric, that fits snugly on the body." Tube tops are generally accepted in the marketplace as cylindrical, shoulderless, sleeveless "tubes" without a defined beginning or end that wrap the torso staying in place by elasticity or by a single strap that is attached to the front of the tube. Examples of patents issued that fit the above definitions of tube top include U.S. Pat. No. 6,863,589, to Cano, entitled "Tube brassiere and method of making" and U.S. Pat. No. 4,667,345, to Jachowski, entitled "Strapless outer garment for a woman." As the specific construct of the devices described in U.S. Pat. No. 6,863,589 and U.S. Pat. No. 4,667,345 constitute enhancements to the standard tube top to meet an intended purpose, so does the specific construct of the fabric breast support which is the subject of this patent application. The construct of the fabric breast support differs from a tube top in the following ways:

(a) The fabric breast support is two sided, meaning both the front plane or right side of the fabric panel that comprises the breast support and the reverse plane or wrong side of the fabric panel that comprises the breast support present a finished surface. The objective for providing a breast support with two finished sides is to provide a therapeutic benefit to the wearer, whereby the wearer's tender breasts and nipples only contact fabric that is soft, soothing and absorbent Tube tops may be made of any fabric and do not require the attribute of two finished sides to achieve this invention's therapeutic benefit.

(b) The fabric breast support is made of fabric that is absorbent. The objective for providing an absorbent breast support is to provide a therapeutic benefit to the wearer whereby the breast support absorbs cool or warm shower water which contributes to its ability to effectively act as a compress when coupled with the gentle compression provided by the stretchable nature of the fabric. Tube tops may be made of any fabric including fabrics that are not absorbent and do not require this attribute of absorbency to achieve this invention's therapeutic benefit.

(c) The fabric breast support is made of fabric that has the ability to stretch or is stretchable. Stretchable is defined by Dictionary.com Unabridged (v 1.1) as "made of synthetic or composite yarn having a sufficiently low denier or having been subjected to any of several special mechanical treatments to permit increased elasticity" and as "of yarn modified or twisted so as to afford high elasticity." Stretch can be obtained either by use of synthetic yarn, elastic yarn or in the knitting/milling process. The objective for providing a stretchable breast support is to provide a therapeutic benefit whereby the breast support may be applied with sufficient firmness or snugness to effectively function as a warm or cool compress. Tube tops may be made of any fabric including fabrics that are not stretchable and do not require this attribute of stretchability to achieve this invention's therapeutic benefit.

(d) The fabric breast support provides an adjustable closure, for example a 4" Velcro® closure. The objective for providing a 4" Velcro® closure is to provide two therapeutic benefits. First, to allow the wearer to deploy the breast support without having to tug the garment over her head and pull down on her tender, sore breasts. Secondly, the wearer's unique bustline measurements and support requirements will change drastically over the course of her pregnancy, after childbirth and during nursing, so having at least a 4" adjustable closure is necessary to ensure proper fit over the course of pregnancy, childbirth and nursing. Because tube tops typically are comprised of one continuous piece of cylindrical fabric and do not have a closure mechanism, they do not achieve this invention's intended therapeutic benefit. Additionally, tops that are not in the form of a tube but that offer a closure mechanism do not offer this extent of size adjustability.

(e) The fabric breast support is made of fabric that is sufficiently thick, generally, and without limitation, within the range of one-eighth inch (⅛") to three-sixteenths inch (3⁄16"). The objective for using fabric that is sufficiently thick is to provide a therapeutic benefit to the wearer whereby the breast support provides a cushion between the stinging shower sprays and the wearer's breasts. The thickness of the fabric used in the construct of the breast support distinguishes it from tube tops and other such apparel in that such tops may be made of any fabric including Spandex or other fabrics that are sheer and thin. These fabrics lack the requisite thickness to provide an effective cushion between the shower sprays and breasts.

U.S. Pat. No. 6,015,331 to Ioakim entitled "Nighttime nursing bra" discloses a terry cloth band that has a finished surface with two critical components identified as (1) elastomeric band members which resiliently collapse around the wearer's body and (2) which has a liner member attached to the interior surface of the cloth band. Ioakim's terry cloth band is not itself made of elastic or stretchable fabric and that is the reason the elastomeric bands are required. The subject invention of this application includes a two-sided, fabric panel, wherein the fabric comprises a stretchable fabric such that the stretchable component is within the fabric structure itself. The properties and functions of the present invention are due to its ideal embodiment being devoid of any bands, whereas Ioakim's requires bands for proper function. Ioakim does not disclose the stretchable fabric of the present invention. Ioakim's device also uses a removable, interior liner member constructed from an absorbent fabric as Ioakim's terry cloth band is not disclosed as being two-sided and does not present on its own a finished, soft and absorbent surface directly adjacent to the wearer's breasts. The properties and functions of the subject invention are due to its ideal embodiment being devoid of this liner member and the number of hook and pile fastener sections that are required to attach the liner member to the terry cloth band, creating unwanted bulk and pressure points on the breasts.

SUMMARY OF THE INVENTION

This invention is a fabric breast support worn in the shower by pregnant, postpartum and nursing mothers to support and protect the breasts, nipples and areolas and relieve breast and nipple pain associated with pregnancy, childbirth and nursing. It solves the foregoing noted problems in that it is a suitably sized, lightweight mechanism that provides gentle bustline support and compression to protect and relieve the breasts and nipples while leaving the wearer's hands free. This invention is easy to wring out, dry and launder and has additional advantages in that it may also be worn outside of the shower to support, protect and relieve the breasts and nipples.

DRAWINGS

Reference Numerals

| |
|---|
| 10-breast support |
| 12-two-sided fabric panel |
| 14-front plane or right side of fabric panel |
| 16-reverse plane or wrong side of fabric panel |
| 18-neckline edge |
| 20-bottom edge |
| 22-right side edge |
| 24-left side edge |
| 26-serged character of panel edges |
| 28-Velcro ® hook |
| 30-Velcro ® loop |
| 32-front, midline of chest |
| 34-bustline |
| 36-back |
| 38-removable securing straps |
| 40-plastic hooks |
| 42-fabric loops |
| 44-neck |

DETAILED DESCRIPTION OF THE PREFERRED EMBODIMENT

Referring to FIGS. 1A and 1B, 2A, and 2B, the breast support 10 consists of a two-sided fabric panel 12 having a length sufficient to wrap around the bustline and back of a pregnant, postpartum or nursing mother (generally within the range of 35 to 43 inches) and a width sufficient to adequately cover the breasts and nipples (generally within the range of 9 to 11 inches). As stated, the fabric panel 12 is two sided, so that both its front plane or right side 14 and reverse plane or wrong side 16 present a finished surface. The front plane or right side 14 and the back plane or wrong side 16 may be formed from the same piece of double-sided fabric and therefore be contiguous or from doubling single-sided fabric. When single-sided fabric is used to construct the fabric panel 12, the wrong sides of the single-sided fabric are placed adjacent to each other so the fabric panel 12 presents a finished surface on both the front plane or right side 14 and the back plane or wrong side 16.

Figure 1A:
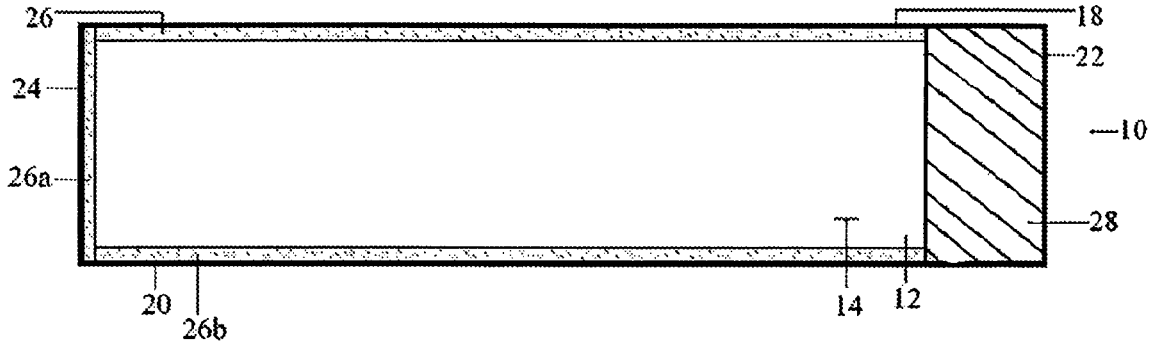
FIG. 1A shows a front view of the breast support as laid on a flat surface showing the hook portion of the Velcro® closure sewn along the right side edge.
Figure 1B:
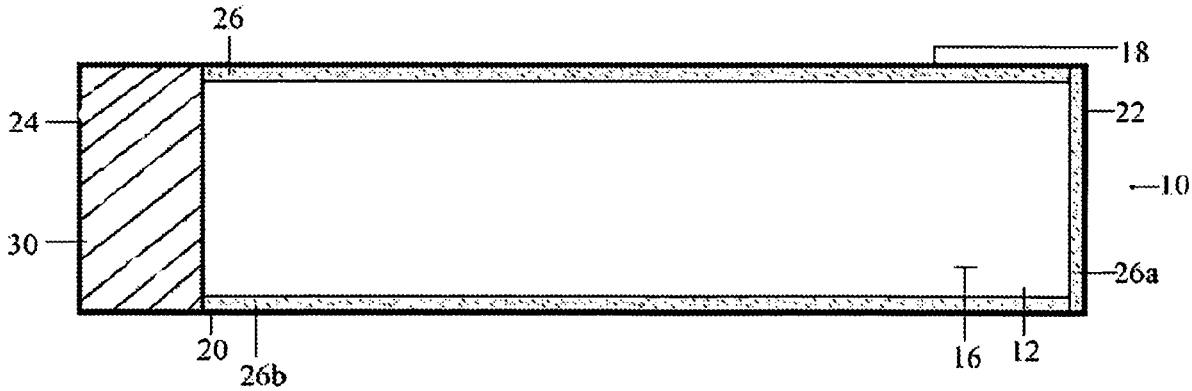
FIG. 1B shows a view of the reverse side of the breast support as laid on a flat surface showing the loop portion of the Velcro® closure sewn along the left side edge.

The fabric panel 12 is bordered by a neckline edge 18, a bottom edge 20 and two spaced-apart side edges, being the right side edge 22 and left side edge 24, which extend from neckline edge 18 to bottom edge 20. As illustrated in FIGS. 1A and 1B, the fabric panel 12 is generally rectangular in shape when laid flat with a straight neckline edge 18, bottom edge 20, and opposing right and left side edges 22, 24. Variations to the generally rectangular shape of the fabric panel 12, including oval or elliptical, and stylistic changes to the straight edges 18-24, such as scalloping, will not depart from the scope of the invention.

Serging 26 finishes the raw edges of the neckline edge 18, bottom edge 20 and spaced-apart right and left side edges 22, 24. Serging is the preferred stitching method to finish the raw edges of the neckline edge 18, bottom edge 20 and spaced-apart right and left side edges 22, 24 as the fabric with which the breast support 10 is crafted is stretchable. Serging is defined as a stitching method of overcasting unfinished seams or edges of fabric to prevent fraying and which allows for expansion and contraction of stretchable or elastic fabric, without causing the stitches to rupture as a traditional straight stitch would when the fabric was pulled longitudinally, horizontally or diagonally. While the neckline edge 18, bottom edge 20 and spaced-apart right and left side edges 22, 24 are illustrated as being finished by serging 26, which is the stitching method used in the preferred embodiment, variations of sewing or finishing methods, including zig-zag stitching or other stitching methods that stretch and do not rupture as the stretchable fabric is pulled longitudinally, horizontally or diagonally will not depart from the scope of the invention.

The fabric panel 12 has a 4" wide strip of Velcro® hook 28 sewn along the right side edge 22 of the fabric panel 12 using a zig-zag stitching method. The Velcro® hook 28 is very low profile, so that it feels smooth to the touch. When one runs their finger over it, one cannot discern that individual hooks are present. This ensures that it will not scratch or irritate the wearer's skin in the event of contact. A 4" wide strip of Velcro® loop 30 is sewn along the opposing left side edge 24 of the fabric panel 12 on the reverse plane 16 of the fabric panel 12, also using a zig-zag stitching method. In the preferred embodiment, a zig-zag stitching method is used to sew the Velcro® hook and loop 28, 30 to the right and left opposing side edges 22, 24 as the fabric from which the breast support 10 is crafted is stretchable. The zig-zag stitching method is a machine stitch in a zig-zag pattern which allows for expansion and contraction of stretchable or elastic fabric, without causing the stitches to rupture as a traditional straight stitch would when the fabric was pulled longitudinally, horizontally or diagonally. Zig-zag stitching also accommodates extra exertion placed on stitches when the wearer pulls on the Velcro® hook and loop closure 28, 30 to open it, whereas traditional straight stitches can rupture under such strain. While the zig-zag stitching method is used in the preferred embodiment, substitution of a different sewing method to attach the hook and loop closure 28, 30 to the opposing right and left side edges 22, 24 of the fabric panel 12 will not depart from the scope of this invention.

In the preferred embodiment, 4" of Velcro® hook and loop 28, 30 are provided so the wearer can pull the breast support 10 as snugly or loosely as she needs to accommodate her unique bustline measurements and support requirements. It should be noted that each wearer's bustline measurements will change drastically over her pregnancy, after childbirth and during nursing, so having at least a 4" strip of Velcro® hook and loop 28, 30 is necessary to ensure proper fit over the course of pregnancy, childbirth and nursing. In the preferred embodiment, the hook and loop 28, 30 is 4" wide Velcro® brand sewn to the right and left opposing side edges 22, 24 of the fabric panel 12 using a zig-zag stitching method. However, substitution of a different width of hook and loop closure, brand of hook and loop closure, or substitution of a different closure method altogether, such as hook and eye, zipper, snap, etc., will not depart from the scope of this invention.

Figure 2A:
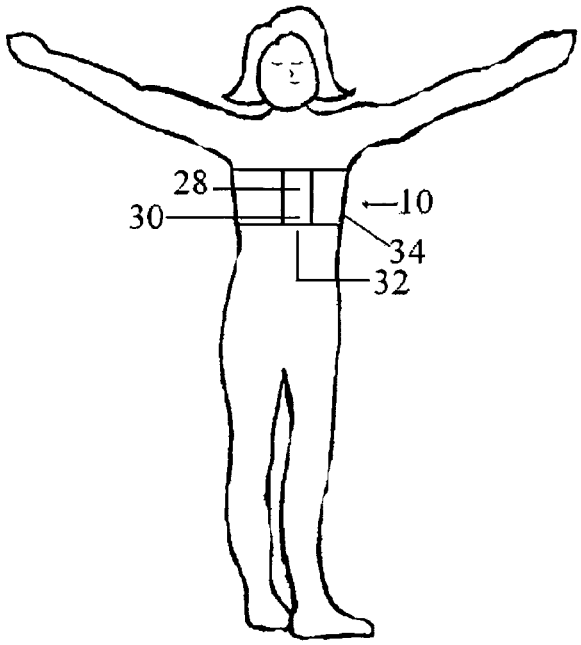
FIG. 2A shows a front view of the breast support deployed by the wearer.
Figure 2B:
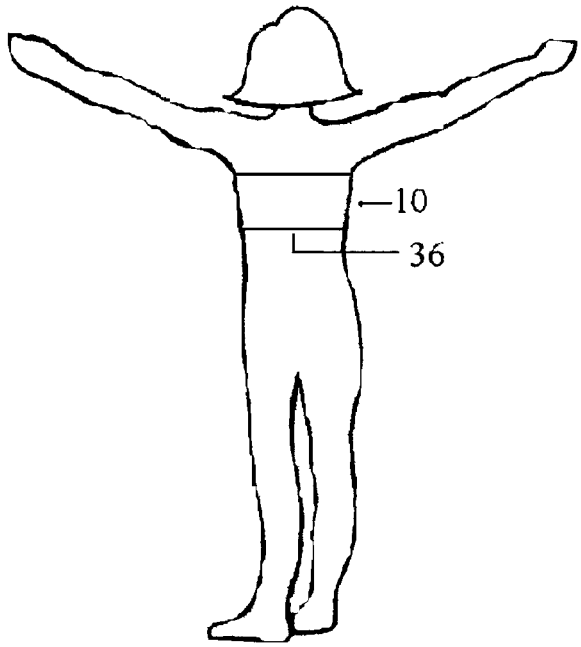
FIG. 2B shows a rear view of the breast support deployed by the wearer.

As shown in FIGS. 2A and 2B, the breast support 10 forms a single continuous two-sided ring that encircles the bustline 34 and back 36 when the hook and loop closures 28, 30 are pressed together by the wearer, shown here along the front, midline of her chest 32.

The fabric that comprises the breast support 10 in the preferred embodiment is a stretch knit terry velour in a blend of 75% cotton and 25% polyester. This fabric was selected for use in the preferred embodiment as it is (1) soft, (2) light weight, (3) absorbent, (4) thick and (5) stretchable (1) Softness: The fabric of the preferred embodiment of the breast support 10 is a knit velour that is velvety soft. Knit velour is a knitted textile produced from joining loops of yarn or thread. Knit Velour combines the stretchy properties of knits with the rich appearance and soft feel of velvet as it has a sheared surface on the front plane or right side of the fabric. In the preferred embodiment, the fabric is a blend of 25% polyester and 75% cotton. Cotton is naturally soft which makes it a preferred fabric for garments worn next to the skin.

(2) Light Weight: The fabric of the preferred embodiment of the breast support 10 is light weight. Fabric weight is defined as the number of ounces per linear yard of fabric and is also generally referred to by people skilled in the art as "light weight," "medium weight," or "heavy weight." The fabric used in the preferred embodiment of this invention is generally described as "light weight" and is generally within the range of eight (8)-twelve (12) ounces per linear yard.

(3) Absorbent: The fabric of the preferred embodiment of the breast support 10 is highly absorbent. The fabric in the preferred embodiment is a blend of 25% polyester and 75% cotton. Cotton has a high absorbency rate and holds up to 27 times its own weight in water.

(4) Thickness: The fabric of the preferred embodiment of the breast support 10 is sufficiently thick, generally within the range of one-eighth inch (⅛") to three-sixteenths inch (3⁄16"). Such thickness provides an effective cushion between the shower sprays and breasts.

(5) Stretchable: The fabric of the preferred embodiment of the breast support 10 is a stretch knit terry velour and is inherently stretchable. Stretchable is defined by Dictionary.com Unabridged (v 1.1) as "made of synthetic or composite yarn having a sufficiently low denier or having been subjected to any of several special mechanical treatments to permit increased elasticity" and as "of yarn modified or twisted so as to afford high elasticity." In the preferred embodiment of the breast support, the stretch of the fabric can be obtained either by use of synthetic yarn, elastic yarn, in the knitting/milling process or by a combination of the aforementioned factors. The fabric structure includes absorbent and elastic yarn within and throughout the fabric structure making up the entire fabric panel.

Knitting is a technique for producing fabric from yarn or thread whereby the yarn or thread follows a meandering pattern to form symmetric loops or stitches above and below a mean path of the yarn or thread. The reason knit fabrics are inherently stretchable is due to this meandering pattern of loops or stitches which allow the fabric to stretch easily in all directions when the loops or stitches are pulled straight. The degree of stretch available in knitted fabric depends on the type of yarn and knitting pattern utilized. The inherent stretchability of knit fabrics allows them to closely follow the body's curvature, which is an important attribute of the subject invention.

It is not necessary to stretch the fabric used in the preferred embodiment of the breast support 10 while sewing as the stretch is built in and is inherent in the fabric as a combined result of its fiber content and the knitting process by which it is manufactured. The degree of stretch built into the fabric used in the preferred embodiment of the breast support 10 is generally within the range of 20 percent to 35 percent stretch, however this range could increase to as much as a 75 percent stretch should a Spandex® or Lycra® fiber be introduced.

While the preferred embodiment of this invention is made of stretch knit terry velour with a content fiber of 25% polyester and 75% cotton, numerous fabrics may be suitable for making this invention, including various cottons, synthetics, blends and combinations thereof including organic and/or elastic fabrics, and a substitution of fabric described in the preferred embodiment will not depart from the scope of the invention.

Operation—FIGS. 1A, 1B, 2A, 2B

As shown in FIGS. 1A and 1B, the breast support is a two-sided fabric panel 12 made of soft, light weight, absorbent, thick and stretchable fabric and is generally rectangular in shape when laid flat. To use, the wearer snuggly wraps the fabric panel 12 around her bustline 34 and back 36, pulling it as tightly or loosely as desired. Then, the wearer attaches the opposing right and left side ends 22, 24 along the front midline of her chest 32 by pressing the Velcro® hook and loop 28, 30 together. FIGS. 2A and 2B show the breast support deployed by the wearer.

ADDITIONAL AND ALTERNATIVE EMBODIMENTS

FIGS. 3, 4A, 4B

Figure 3:
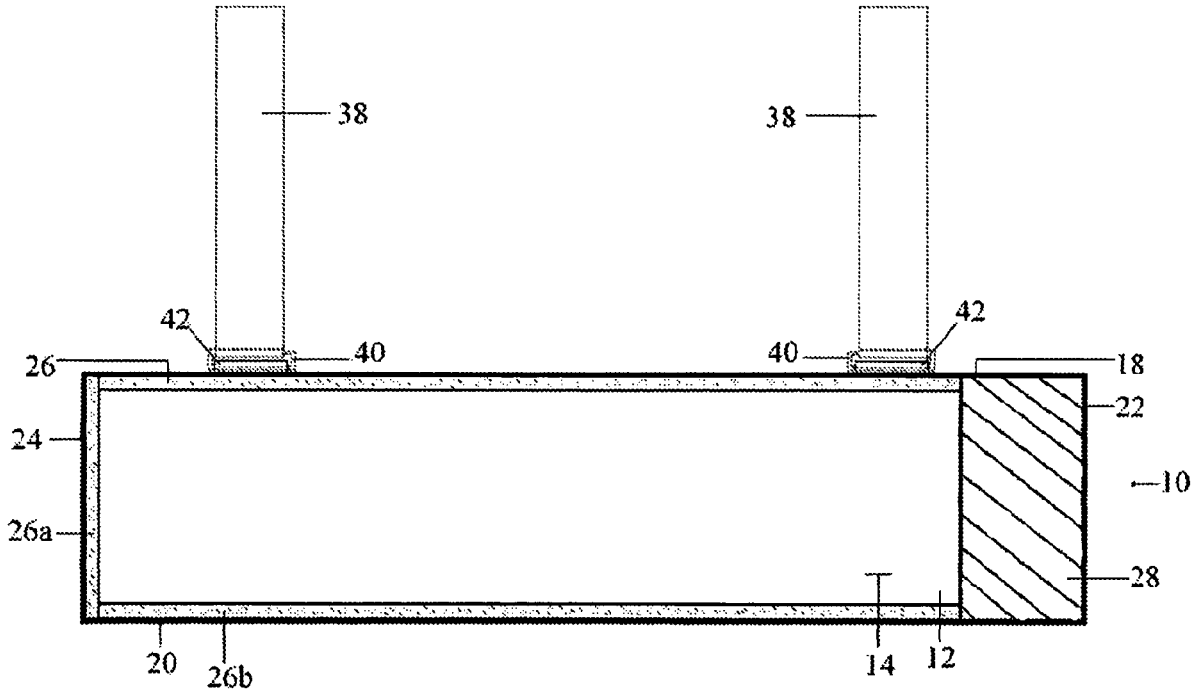
FIG. 3 shows a front view of the breast support as laid on a flat surface showing the hook portion of the Velcro® closure sewn along the right side edge and securing support straps sewn along either side of the neckline edge.
Figure 4A:
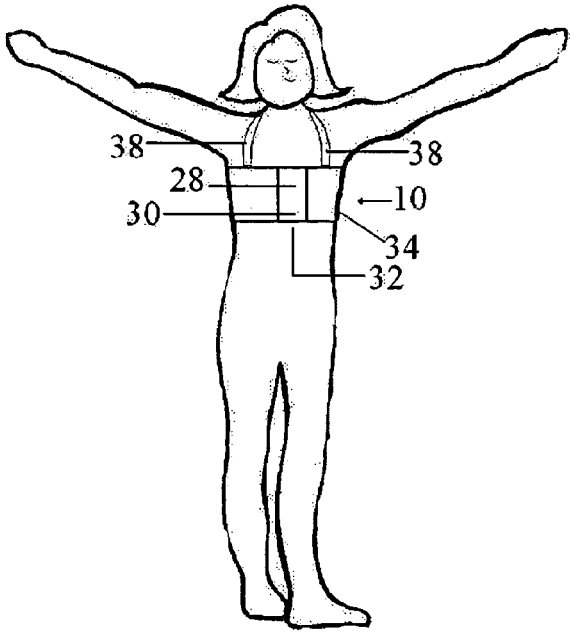
FIG. 4A shows a front view of the breast support deployed by the wearer with securing support straps tied around the wearer's neck.
Figure 4B:
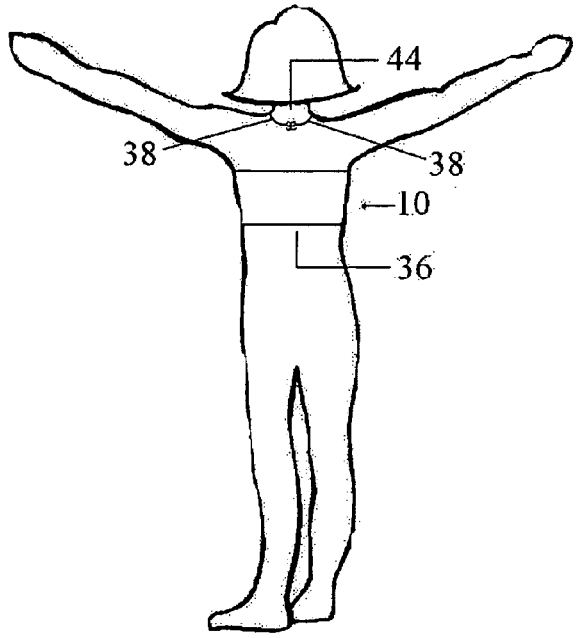
FIG. 4B shows a rear view of the breast support deployed by the wearer with securing support straps tied around the wearer's neck.

As shown in FIG. 3, one embodiment of the breast support 10 includes removable securing straps 38 extending from either end of neckline edge 18, which function to provide an optional and additional means for securing the breast support 10 around the neck 44 of a pregnant, postpartum, or nursing mother as illustrated in FIGS. 4A and 4B. In this embodiment, the securing straps 38 are attached to the neckline edge 18 of the breast support 10 by plastic hooks 40 that are sewn onto one end of each securing strap 38. The plastic hooks 40 are connected to the neckline edge 18 by inserting them into fabric loops 42 that are sewn along the neckline edge 18 of the breast support 10. Note that the breast support 10 stays in place on its own without the use of securing straps 38 when secured snuggly around the bustline and back as shown in the preferred embodiment, however, some women prefer the additional support provided to the breasts when the securing straps 38 are secured around the neck 44. The removable securing straps 38 can be secured around the neck 44 by simply tying in a bow or the like, as shown in FIG. 3B, or can include any other well known securing means, such as Velcro®, snaps, loop and hook, buttons, etc. While one embodiment of the breast support 10 is illustrated as having removable securing straps 38, the absence of removable securing straps 38 will not depart from the scope of the invention.

Advantages

From the description above, a number of advantages of some embodiments of my breast support become evident:

(a) This invention is the proper size to adequately cover the breast and nipple region without covering more body area than preferred.

(b) This invention is made of light weight, stretchable fabric that does not become heavy or cumbersome when wet or place surplus weight on the mother's breasts.

(c) This invention does not require the wearer to manually hold it in place, leaving both hands free to shower.

(d) This invention is made of a soft, lightweight, stretchable fabric that, when worn by the pregnant or new mother, provides gentle bustline support to reduce breast discomfort and strain on delicate, stretched breast tissue. The thickness of the fabric provides a cushion between stinging shower sprays and sore breasts and nipples.

(e) This invention is made of absorbent, stretchable fabric which allows it to effectively function as a cool or warm compress. When worn in the shower, the breast support absorbs cool or warm shower water and can be applied with sufficient firmness and snugness to gently compress the breast area without direct assistance of the wearer.

(f) This invention is easy to wring out, hang dry and launder.

CONCLUSIONS, RAMIFICATIONS AND SCOPE

The fabric breast support of the preferred embodiment is worn inside the shower to support and protect the breasts and relieve breast and nipple pain associated with pregnancy, childbirth and nursing while leaving the wearer's hands free by 1) creating a physical barrier between the breast area and stinging shower sprays, soap and other chemical residues found in many toiletries and 2) functioning as a warm compress to alleviate breast discomfort caused by swelling, engorgement, localized blockages of milk ducts, nipple trauma and breast infection. The breast support is correctly sized so that it only covers the breast area, and not other parts of the body the wearer wishes exposed directly to shower sprays, soap and toiletries. The breast support is light weight, and is easy to wring out, hang dry and launder.

Although the description above contains many specificities, these should not be construed as limiting the scope of the embodiments but as merely providing illustrations of some of the presently preferred embodiments. For example, the breast support can have other shapes, such as oblong; the hook and loop closure can be replaced by a different closure method, such as hook and eye or zipper; a different fabric including organic alternatives can be used in the construction of the breast support, etc.

Thus the scope of the embodiment should be determined by the appended claims and their legal equivalents, rather than by the examples given.

I claim:

1. A method for supporting, protecting and relieving the breasts, nipples and areolas of pregnant, postpartum or nursing mothers when the mother is showering, said method comprising:

(a) providing a fabric breast support, comprising:

a two-sided absorbent and compressive stretchable fabric panel that comprises a fabric structure with absorbent and elastic yarn within and throughout the fabric structure making up the entire fabric panel, said fabric panel having a front plane and an opposing back plane, both of which present a finished surface, a length to surround the bustline and back of a pregnant, postpartum or nursing mother, and a width to adequately cover the mother's breasts and nipples;

a neckline edge, a bottom edge and two spaced-apart opposing side edges extending from the ends of said neckline edge to the bottom edge, so that said fabric panel forms a generally rectangular shape when laid flat; and a size adjustable closing mechanism that allows one side edge of the fabric panel to adjoin or cover the opposing side edge of the fabric panel, such that the fabric panel forms a single continuous band of fabric when one side edge is adjoined to or covers the opposing side edge by means of the closing mechanism;

(b) snugly wrapping the fabric breast support lengthwise around the bustline and back of the pregnant, postpartum, or breastfeeding mother;

(c) adjoining the opposing ends of said breast support, generally along the front mid-line of the pregnant, postpartum, or breastfeeding mother's chest; and (d) the pregnant, postpartum, or breastfeeding mother's showering while wearing the fabric breast support to support and protect the breasts and nipples and to relieve breast and nipple pain associated with pregnancy, postpartum recovery, and breastfeeding while showering.

2. The method of claim 1, wherein said fabric breast support comprises a fabric panel having a length of between 35 inches to 43 inches, and a width of between 9 inches to 11 inches.

3. The method of claim 1, wherein said fabric breast support comprises a fabric panel having a thickness of between 1/8 inch to 3/16 inch.

4. The method of claim 1, wherein said fabric breast support comprises a light weight fabric having between 8 ounces to 12 ounces per linear yard.

5. The method of claim 1, wherein said fabric breast support comprises a fabric that is able to stretch between 20 to 30 percent.

6. The method of claim 1, wherein said fabric breast support comprises a fabric having a soft, lightweight, absorbent, thick and stretchable fabric to allow the breast support to softly and snugly conform to the pregnant, postpartum or breastfeeding mother's breast area, to allow for expansion and contraction as necessary to accommodate each user's unique bustline measurements, to provide gentle bustline support when showering, to provide a cushion between shower sprays and the user's breasts and nipples, to function as a warm compress to help relieve breast and nipple pain associated with pregnancy, childbirth, and breastfeeding, and to allow the breast cover to stay in place on its own without a manual means to hold the breast support in place or direct assistance from the wearer.

* * * * *